US011060513B2

(12) United States Patent
Rafalskyi et al.

(10) Patent No.: US 11,060,513 B2
(45) Date of Patent: Jul. 13, 2021

(54) GRIDDED ION THRUSTER WITH INTEGRATED SOLID PROPELLANT

(71) Applicants: ECOLE POLYTECHNIQUE, Palaiseau (FR); CENTRE NATIONAL DE LA RECHERCHE SCIENTIFIQUE, Paris (FR)

(72) Inventors: Dmytro Rafalskyi, Orsay (FR); Ane Aanesland, Paris (FR)

(73) Assignees: ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 517 days.

(21) Appl. No.: 15/755,322

(22) PCT Filed: Aug. 30, 2016

(86) PCT No.: PCT/EP2016/070412
§ 371 (c)(1),
(2) Date: Feb. 26, 2018

(87) PCT Pub. No.: WO2017/037062
PCT Pub. Date: Mar. 9, 2017

(65) Prior Publication Data

US 2018/0216605 A1 Aug. 2, 2018

(30) Foreign Application Priority Data

Aug. 31, 2015 (FR) ..... 1558071

(51) Int. Cl.
*F03H 1/00* (2006.01)
*H05H 1/54* (2006.01)

(52) U.S. Cl.
CPC ..... *F03H 1/0012* (2013.01); *F03H 1/0043* (2013.01); *F03H 1/0081* (2013.01); *H05H 1/54* (2013.01)

(58) Field of Classification Search
CPC ..... F03H 1/00; F03H 1/0006; F03H 1/0012; F03H 1/0018; F03H 1/0037;
(Continued)

(56) References Cited

U.S. PATENT DOCUMENTS 5,924,277 A 7/1999 Beattie et al.
5,945,781 A 8/1999 Valentian
(Continued)

OTHER PUBLICATIONS

Simon "Development of a Radio-Frequency Generator for RF Ion Thrusters" (Year: 2015).*
(Continued)

*Primary Examiner* — Gerald L Sung
*Assistant Examiner* — William L Breazeal
(74) *Attorney, Agent, or Firm* — Duane Morris LLP; Gregory M. Lefkowitz; Brandon A. Chan

(57) ABSTRACT

The invention relates to an ion thruster, comprising:
a chamber,
a reservoir, comprising a solid propellant (PS), housed in the chamber and comprising a conductive jacket provided with an orifice;
means for forming an ion-electron plasma in the chamber, which means are able to sublime the solid propellant in the reservoir, then to generate said plasma in the chamber from the sublimed propellant coming from the reservoir through the orifice;
a means for extracting and accelerating the ions and electrons of the plasma out of the chamber, which means comprises at least two grids at one end (E) of the chamber;
(Continued)

a radiofrequency AC voltage source for generating a radiofrequency signal comprised between the plasma frequencies of the ions and of the electrons, arranged in series with a capacitor and connected, by one of its outputs and via this capacitor, to one of the grids, with the other grid being connected to the other output of said voltage source;

said means for extracting and accelerating and said voltage source making it possible to form, at the output of the chamber, an ion-electron beam.

14 Claims, 7 Drawing Sheets

(58) Field of Classification Search
CPC ..... F03H 1/0043; F03H 1/0056; B64G 1/405; B64G 1/42; B64G 1/443; B64G 1/44
See application file for complete search history.

(56) References Cited

U.S. PATENT DOCUMENTS

| | | | | |
|---|---|---|---|---|
| 6,609,363 | B1 * | 8/2003 | Dressler | F03H 1/0012 60/202 |
| 7,059,111 | B2 | 6/2006 | King | |
| 8,610,356 | B2 | 12/2013 | Szabo, Jr. et al. | |
| 2007/0056262 | A1 | 3/2007 | Leach et al. | |
| 2009/0066256 | A1 | 3/2009 | Stone et al. | |
| 2011/0277444 | A1 * | 11/2011 | Leiter | B64G 1/405 60/202 |
| 2013/0067883 | A1 | 3/2013 | Emsellem et al. | |

OTHER PUBLICATIONS

Volkmar "Radio-Frequency Ion Thrusters Power Measurement and Power Distribution Modeling" (Year: 2014).*

Bumbarger "Analysis of a Miniature Radio Frequency Ion Thruster With an Inductively Coupled Plasma Source" (Year: 2013).*

Conversano "Mission Capability Assessment of CubeSats Using a Miniature Ion Thruster" (Year: 2013).*

Nicolini "Plasma Measurements in the ESA electric prolusion laboratory" (Year: 2001).*

Michael Keidar et al: "Electric propulsion for small satellites", Plasma Physics and Controlled Fusion, IOP, Bristol, GB, vol. 57, No. 1, Nov. 28, 2014 (Nov. 28, 2014), pp. 14005, XP020276224, ISSN: 0741-3335, [retrieved on Nov. 28, 2014], DOI: 10.1088/0741-3335/57/1/014005.

Kurt A. Polzin et al: "Iodine Hall Thruster Propellant Feed System for a CubeSat", 50th AIAA/ASME/SAE/ASEE Joint Propulsion Conference, Jul. 28, 2014 (Jul. 28, 2014), Reston, Virginia, XP055292310, ISBN: 978-1-62410-303-2, DOI: 10.2514/6.2014-3915.

Kurt A Polzin et al: "Propulsion System Development for the Iodine Satellite (iSAT) Demonstration Mission", IEPC-2015-09 ISTS-2015-B-09 Presented at Joint Conference of 30th International Symposium on Space Technology and Science, Jul. 4, 2015 (Jul. 4, 2015), XP055292349, Retrieved from the Internet <URL:http://erps.spacegrant.org/uploads/images/2015Presentations/IEPC-2015-09_ISTS-2015-b-09.pdf> [retrieved on Jul. 29, 2016].

Éditions Larousse: "Encyclopédie Larousse en ligne—propergol", Jul. 29, 2016 (Jul. 29, 2016), XP055292191, Retrieved from the Internet <URL:http://www.larousse.fr/encyclopedie/divers/propergol/83601> [retrieved on Jul. 29, 2016].

Éditions Larousse: "Encyclopédie Larousse en ligne—propulsion ionique", Jul. 29, 2016 (Jul. 29, 2016), XP055292188, Retrieved from the Internet <URL:www.larousse.fr/encyclopedie/divers/propulsion_ionique/62525> [retrieved on Jul. 29, 2016].

Trevor Alain Lafleur et al: "Proof-of-concept demonstration of the PEGASES plasma thruster / Paper IEPC-2015-114/ISTS-2015-b-114", Presented at Joint Conference of 30th International Symposium on Space Technology and Science, Jul. 4, 2015 (Jul. 4, 2015), XP055292513, Retrieved from the Internet <URL:http://erps.spacegrant.org/uploads/images/2015Presentations/IEPC-2015-114_ISTS-2015-b-114.pdf> [retrieved on Aug. 1, 2016].

* cited by examiner

GRIDDED ION THRUSTER WITH INTEGRATED SOLID PROPELLANT

CROSS-REFERENCE TO RELATED APPLICATIONS

This application is a § 371 national stage entry of International Application No. PCT/EP2016/070412, filed Aug. 30, 2016, which claims priority to French Patent Application No. 1558071, filed Aug. 31, 2015, the entire contents of which are incorporated herein by reference.

The invention relates to a plasma thruster comprising an integrated solid propellant.

The invention relates more precisely to an ion thruster, with a grid, comprising an integrated solid propellant.

The invention can have application for a satellite or a space probe.

More particularly, the invention can have application for small satellites. Typically, the invention will have an application for satellites having a weight between 6 kg and 100 kg, optionally able to range up to 500 kg. A particularly interesting case of application relates to the "CubeSat" of which a base module (U) weighs less than 1 kg and has dimensions of 10 cm*10 cm*10 cm. The plasma thruster according to the invention can in particular be integrated into a module 1U or a demi-module (½U) and used in stacks of several modules by 2 (2U), 3 (3U), 6 (6U), 12 (12U) or more.

A solid propellant plasma thruster has already been proposed.

They can be classed into two categories, according to whether or not they implement a plasma chamber.

In the article of Keidar & al., "*Electric propulsion for small satellites*", Plasma Phys. Control. Fusion, 57 (2015) (D1), various techniques are described for generating a plasma from a solid propellant, all based on an ablation of a solid propellant. The solid propellant directly gives onto the exterior space, namely space for satellites or space probes, without a plasma chamber.

According to a first technique, Teflon (solid propellant) is arranged between an anode and a cathode between which an electrical discharge is carried out. This electrical discharge causes the ablation of the Teflon, its ionisation and its acceleration primarily electromagnetically in order to generate a beam of ions directly in the external space.

According to a second technique, a laser beam is used to carry out the ablation and the ionisation of a solid propellant, for example PVC or Kapton®. The acceleration of the ions is generally carried out electromagnetically.

According to a third technique, an insulator is arranged between an anode and a cathode, all in a vacuum. The cathode, metal, is used as an ablation material in order to generate ions. The acceleration is carried out electromagnetically.

The techniques described in this document make it possible to obtain a relatively compact thruster. Indeed, the solid propellant is ablated, ionised and the ions are accelerated in order to ensure propulsion with an all-in-one device.

However, the consequence is that there is no separate control of the sublimation of the solid propellant, of the plasma and of the beam of ions.

In particular, the beam of ions is more or less controlled due to the fact that there are no separate means for controlling the density of the plasma induced by the ablation of the solid propellant and the speed of the ions. Consequently, the thrust and the specific pulse of the thruster cannot be controlled separately.

We do not generally have this type of disadvantage when a plasma chamber is implemented.

The article by Polzin & al., "*Iodine Hall Thruster Propellant Feed System for a CubeSat*", American Institute of Aeronautics and Astronautics (D2) proposes a solid propellant feed system for a thruster operating under the Hall effect.

This feed system can be used for any thruster that implements a plasma chamber.

Indeed, in article D2, the solid propellant (here, iodine $I_2$) is stored in a reservoir. A means for heating is associated with the reservoir. This means for heating can be an element able to receive external radiation, placed on the outside of the reservoir. As such, when the reservoir is heated, diatomic iodine is sublimed. Diatomic iodine in gaseous state exits from the reservoir and is directed towards a chamber, located at a distance from the reservoir, where it is ionised in order to form a plasma. The ionisation is carried out, here, via the Hall effect. The flow rate of the gas entering into the plasma chamber is controlled by a valve arranged between the reservoir and this chamber. A better control of the sublimation of the diatomic iodine and of the characteristics of the plasma can as such be carried out, in relation to the techniques described in document D1.

Moreover, the characteristics of the beam of ions exiting from the chamber can then be controlled by a means for extracting and accelerating ions separated from the means implemented to sublime the solid propellant and generate the plasma.

This system therefore has many advantages in relation to those described in document D1.

However, in document D2, the presence of such a feed system renders the plasma thruster hardly compact and consequently, hardly able to be considered for small satellites, in particular for a module of the "CubeSat" type.

In U.S. Pat. No. 8,610,356 (D3), a system is also proposed that uses a propellant such as iodine ($I_2$) stored in a reservoir located at a distance from a plasma chamber. The control of the flow rate of diatomic iodine gas exiting from the reservoir is carried out by temperature and pressure sensors installed at the outlet of the reservoir and connected to a control loop of the temperature of the reservoir.

Here also, the system is not very compact.

In the same type of system as those proposed in documents D2 or D3, mention can also be made of U.S. Pat. No. 6,609,363 (D4).

Note that an integrated propellant plasma thruster in a plasma chamber has already been proposed in U.S. Pat. No. 7,059,111 (D5). This plasma thruster, based on the Hall effect, is therefore able to be more compact than that proposed in documents D2, D3 or D4. It is also able to better control the evaporation of the propellant, the plasma and the extraction of ions, in relation to document D1. However, the propellant is stored in liquid state and uses an additional system of electrodes to control the flow rate of gas exiting from the reservoir.

An objective of the invention is to overcome at least one of the aforementioned disadvantages.

In order to achieve this objective, the invention proposes an ion thruster, characterised in that it comprises:

a chamber, a reservoir comprising a solid propellant, said reservoir being housed in the chamber and comprising a conductive jacket provided with at least one orifice;

a set of means for forming an ion-electron plasma in the chamber, said set being able to sublime the solid propellant in the reservoir in order to form a propellant in the gaseous state, then to generate said plasma in the chamber from the propellant in the gaseous state coming from the reservoir through said at least one orifice;

a means for extracting and accelerating at least the ions of the plasma out of the chamber, said means for extracting and accelerating comprising:

either an electrode housed in the chamber to which is associated a grid located at one end of the chamber, said electrode having a surface that is greater than the surface of the grid, or a set of at least two grids located at one end of the chamber;

a radiofrequency DC voltage source or AC voltage source arranged in series with a capacitor and adapted for generating a signal of which the radiofrequency is between the plasma frequencies of the ions and the plasma frequency of the electrons, said radiofrequency DC or AC voltage source being connected, by one of its outputs, to the means for extracting and accelerating at least the ions of the plasma out of the chamber, and more precisely:

either to the electrode, or to one of the grids of said set of at least two grids, the grid associated with the electrode or, according to the case, the other grid of said set of at least two grids being either set to a reference potential, or connected to the other of the outputs of said radiofrequency AC voltage source;

said means for extracting and accelerating and said radiofrequency DC or AC voltage source making it possible to form, at the output of the chamber, a beam comprising at least ions.

The thruster can also comprise at least one of the following characteristics, taken separately or in combination:

the voltage source connected to the means for extracting and accelerating is a radiofrequency AC voltage source, and the set of means for forming the ion-electron plasma comprises at least one coil powered by this same radiofrequency AC voltage source by the intermediary of a means for managing the signal supplied by said radiofrequency voltage source in the direction on the one hand, of said at least one coil and on the other hand, of the means for extracting and accelerating, in order to form a beam of ions and of electrons at the output of the chamber;

the set of means for forming the ions-electron plasma comprises at least one coil powered by a radiofrequency AC voltage source that is different from the radiofrequency AC or DC voltage source connected to the means for extracting and accelerating or at least one microwave antenna powered by a microwave AC voltage source;

the voltage source connected to the means for extracting and accelerating is a radiofrequency AC voltage source, in order to form, at the output of the chamber, a beam of ions and of electrons;

the means for extracting and accelerating is a set of at least two grids located at one end of the chamber, the electroneutrality of the beam of ions and of electrons is obtained at least partially by adjusting the application duration of the positive and/or negative potentials coming from the radiofrequency AC voltage source connected to the means for extracting and accelerating;

the means for extracting and accelerating is a set of at least two grids located at one end of the chamber, the electroneutrality of the beam of ions and of electrons is obtained at least partially by adjusting the amplitude of the positive and/or negative potentials coming from the radiofrequency AC voltage source connected to the means for extracting and accelerating;

the voltage source connected to the means for extracting and accelerating is a DC voltage source, in order to form, at the output of the chamber, a beam of ions, with the thruster further comprising means for injecting electrons into said beam of ions in order to provide electroneutrality;

the reservoir comprises a membrane located between the solid propellant and the jacket provided with at least one orifice, said membrane comprising at least one orifice, with the surface of the or of each orifice of the membrane being larger than the surface of the or of each orifice of the jacket of the reservoir;

the or each grid has orifices of which the shape is chosen from the following shapes: circular, square, rectangle or in the form of slots, in particular parallel slots;

the or each grid has circular orifices, of which the diameter is between 0.2 mm and 10 mm, for example between 0.5 mm and 2 mm;

when the means for extracting and accelerating out of the chamber comprises a set of at least two grids located at the end of the chamber, the distance between the two grids is between 0.2 mm and 10 mm, for example between 0.5 mm and 2 mm;

the solid propellant is chosen from: diatomic iodine, diatomic iodine mixed with other chemical components, ferrocene, adamantane or arsenic.

The invention also relates to a satellite comprising a thruster according to the invention and a source of energy, for example a battery or a solar panel, connected to the or to each DC or AC voltage source of the thruster.

The invention also relates to a space probe comprising a thruster according to the invention and a source of energy, for example a battery or a solar panel, connected to the or to each DC or AC voltage source of the thruster.

The invention shall be better understood and other purposes, advantages and characteristics of the latter shall appear more clearly when reading the following description and which is given with respect to the annexed figures, wherein.

Figure 1:
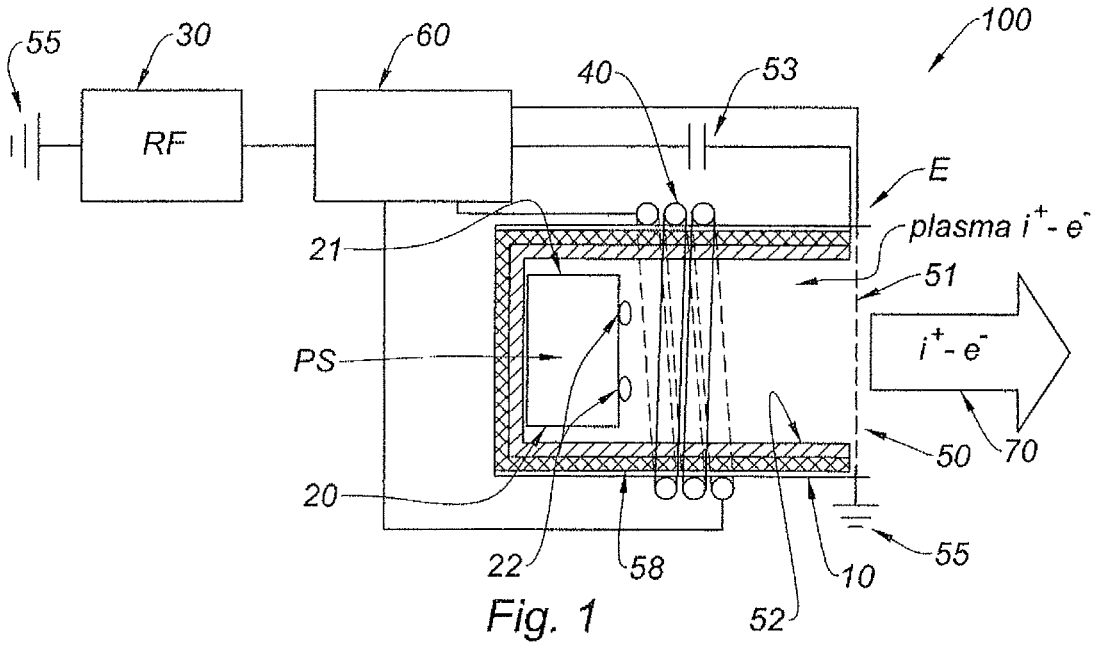
FIG. 1 is a diagrammatical view of a plasma thruster according to a first embodiment of the invention.

A first embodiment of an ion thruster 100 according to the invention is shown in FIG. 1.

The thruster 100 comprises a plasma chamber 10 and a reservoir 20 of solid propellant PS housed in the chamber 10. More precisely, the reservoir 20 comprises a conductive jacket 21 comprising the solid propellant PS, with this jacket 21 being provided with one or several orifices 22. Housing the reservoir 20 of solid propellant in the chamber 10 provides the thruster with greater compactness.

The thruster 100 also comprises a radiofrequency AC voltage source 30 and one or several coils 40 powered by the radiofrequency AC voltage source 30. The or each coil 40 can have one or several winding(s). In FIG. 1, a single coil 40 comprising several windings is provided.

The coil 40, powered by the radiofrequency AC voltage source 30, induces a current in the reservoir 20, which is conductive (eddy current). The courant induced in the reservoir causes a Joule effect which heats the reservoir 20. The heat produced as such is transmitted to the solid propellant PS via thermal conduction and/or thermal radiation. The heating of the solid propellant PS then makes it possible to sublime the latter, with the propellant being as such put in gaseous state. Then, the propellant in gaseous state passes through the orifice or orifices 22 of the reservoir 20, in the direction of the chamber 10. This same set 30, 40 moreover makes it possible to generate a plasma in the chamber 10 by ionising the propellant in gaseous state which is in the chamber 10. The plasma formed as such will generally be an ion-electron plasma (note that the plasma chamber will also comprise neutral species—propellant in gaseous state—because, generally, not all of the gas is ionised to form the plasma).

The same radiofrequency AC voltage source 30 is therefore used to sublime the solid propellant PS and create the plasma in the chamber 10. In the case here, a single coil 40 is also used for this purpose. However, it can be considered to provide several coils, for example a coil in order to sublime the solid propellant PS and a coil for creating the plasma. By using several coils 40, it is then possible to increase the length of the chamber 10.

More precisely, the chamber 10 and the reservoir 20 are initially at the same temperature.

When the source 30 is implemented, the temperature of the reservoir 20, heated by the coil or coils 40, increases. The temperature of the solid propellant PS also increases, with the propellant being in thermal contact with the jacket 21 of the reservoir.

This causes a sublimation of the solid propellant PS, within the reservoir 20, and subsequently an increase in the pressure P1 of the propellant in the gaseous state within the reservoir 20 accompanying the increase in temperature T1 in this reservoir.

Then, under the effect of the difference in pressure between the reservoir 20 and the chamber 10, the propellant in gaseous state passes through the or each orifice 22 in the direction of the chamber 10.

When the conditions of temperature and of pressure are sufficiently substantial in the chamber 10, the unit formed by the source 30 and the coil or coils 40 makes it possible to generate the plasma in the chamber 10. At this stage, the solid propellant PS is then more amply heated by the charged particles of the plasma, with the coil or coils being shielded by the presence of the sheath in the plasma (skin effect) as well as by the presence of particles themselves charges within the plasma.

In the presence of the plasma (thruster in operation), note that the temperature of the reservoir 20 can be controlled better by the presence of a heat exchanger (not shown) connected to the reservoir 20.

One or several orifices 22 can be provided on the reservoir 20, this has no importance. Only the total surface of the orifice or, if several orifices are provided, of all of these orifices is of importance. The sizing thereof will depend on the nature of the solid propellant used, and desired operating parameters for the plasma (temperature, pressure).

This sizing will therefore be carried out case by case.

Generally, the sizing of the thruster according to the invention will include the following steps.

The volume of the chamber 10 is first defined, as well as the nominal operating pressure P2 desired in this chamber 10 and the mass flow rate m' of positive ions desired at the output of the chamber 10. This data can be obtained by digital modelling or through routine tests. Note that this mass flow rate (m') corresponds substantially to that found between the reservoir 20 and the chamber 10.

Then, the desired temperature T1 for the reservoir 20 is chosen.

Figure 13:
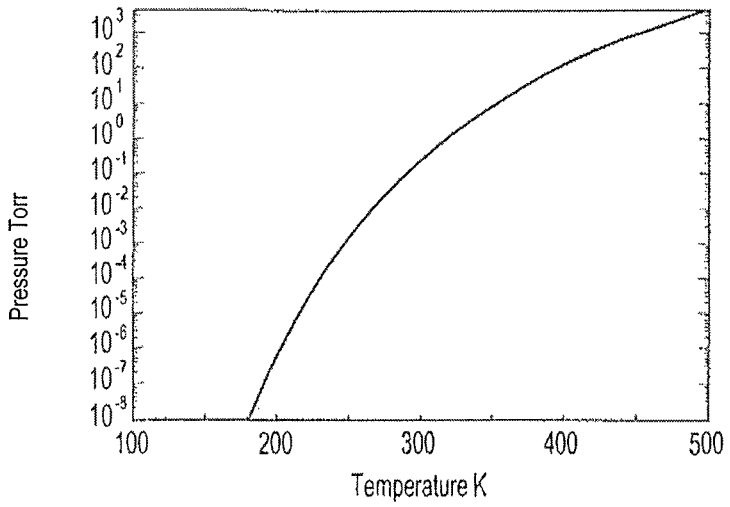
FIG. 13 is a curve providing, in the case of diatomic iodine ($I_2$) used as a solid propellant, the change in the pressure of vapours of diatomic iodine according to the temperature.

As this temperature T1 is fixed, the corresponding pressure of the propellant in the gaseous state can be known, namely the pressure P1 of this gas in the reservoir 20 (cf. FIG. 13 in the case of diatomic iodine $I_2$).

Knowing as such P2, m', P1 and T1, it is possible to deduce therefrom the surface A of the orifice or, if several orifices are provided, of all of the orifices. Advantageously, several orifices will however be provided in order to ensure a more homogeneous distribution of the propellant in gaseous state within the chamber 10.

A sizing example is however provided hereinafter.

It is then possible to estimate the leakage of propellant in gaseous state between the reservoir 20 and the chamber 10 when the thruster 100 is stopped. Indeed, in this case, the surface A of the orifices is known, just as P1, T1 and P2, which makes it possible to obtain m' (leakage rate). In practice, it is shown that when stopped, the leak is minimal in relation to the propellant flow rate in gaseous state passing from the reservoir 20 to the chamber 10 during use. That is why, in the framework of the invention, the presence of valves on orifices is not required.

For the solid propellant, the following can be considered: diatomic iodine ($I_2$), a mixture of diatomic iodine ($I_2$) with other chemical components, adamantane (crude chemical formula: $C_{10}H_{16}$) or ferrocene (crude chemical formula: $Fe(C_5H_5)_2$). Arsenic can also be used, but its toxicity makes it a solid propellant of which the use is considered less.

Advantageously, diatomic iodine ($I_2$) will be used as a solid propellant.

This propellant has indeed several advantages. As shown in FIG. 13, a curve providing, in the case of diatomic iodine ($I_2$), the change in the pressure P of the diatomic iodine gas according to the temperature T. This curve can be approximated by the following formula:

$$\mathrm{Log}(P)=-3512.8*(1/T)-2{,}013*\log(T)+13.374 \quad \text{(F1)}$$

with:

P, the pressure in Torr;

T, the temperature in Kelvin.

This formula can be obtained in "*The Vapor Pressure Iodine*", G. P. Baxter, C. H. Hickey, W. C. Holmes, *J. Am. Chem. Soc.,* 1907, 29(2) pp. 12-136. This formula is also mentioned in "*The normal Vapor Pressure of Crystalline Iodine*", L. J. Gillespie, & al., *J. Am. Chem Soc.,* 1936, vol. 58(11), pp 2260-2263. This formula has been the object of experimental verifications, by various authors.

When the thruster switches from a stopped mode to a nominal operating mode, it can be considered that the temperature increases by about 50K. In the temperature range between 300K and 400K, this FIG. 13 shows that the pressure of the diatomic iodine gas increases practically by a factor of 100, for an increase in temperature of 50K.

Also, when the thruster is in stopped mode, the leakage of iodine gas through the or each orifice 22 is very low, and of about 100 times less than the quantity of diatomic iodine gas passing through the orifice or orifices 22 in the direction of the chamber 10, when the thruster 100 is in nominal operation.

A more substantial difference between the nominal operating temperature of the thruster according to the invention and it temperature when stopped will only decrease the relative losses through the leakage of propellant in the gaseous state.

Consequently, a thruster 100 according to the invention that uses diatomic iodine ($I_2$) as a propellant does not need to implement a valve for the or each orifice and this, contrary to document D2. This simplifies by as much the design of the thruster and provides it with good reliability. The control of the flow rate of propellant in gaseous state is done by controlling the temperature of the reservoir 20, by the intermediary of the power supplied to the coil 40 by the radiofrequency AC voltage source 30 and optionally, as states hereinabove, by the presence of a heat exchanger connected to the reservoir 20. The control is therefore different from that which is carried out in document D3.

The thruster 100 also comprises a means 50 for extracting and accelerating charged particles of the plasma, positive ions and electrons, out of the chamber 20 in order to form a beam 70 of charged particles at the output of the chamber 20. In FIG. 1, this means 50 comprises a grid 51 located at one end E (output) of the chamber 10 and an electrode 52 housed inside the chamber 10, with this electrode 52 having by construction a surface that is greater than that of the grid 51. In certain cases, the electrode 52 can be formed by the wall itself, conductive, of the reservoir 20.

The electrode 52 is insulated from the wall of the chamber by an electrical insulator 58.

The grid 51 can have orifices of different shapes, for example circular, square, rectangle or in the form of slots, in particular parallel slots. In particular, in the case of circular orifices, the diameter of an orifice can be between 0.2 mm and 10 mm, for example between 0.5 mm and 2 mm.

In order to ensure this extraction and acceleration, the means 50 is connected to the radiofrequency AC voltage source 30. The radiofrequency AC voltage source 30 thus provides, in addition, the control of the means 50 for extracting and accelerating charged particles out of the chamber 10. This is particularly interesting as it makes it possible to further increase a little more the compactness of the thruster 100. In addition, this control of the means 50 for extracting and accelerating by the radiofrequency AC voltage source 30 makes it possible to control the beam 70 of charged particles better and this, contrary to the techniques proposed in article D1 in particular. Finally, this control also makes it possible to obtain a beam with a very good electroneutrality at the output of the chamber 10, without implementing any external device whatsoever for this purpose. In other words, the unit formed by the means 50 for extracting and accelerating charged particles of the plasma and the radiofrequency AC voltage source 30 therefore also makes it possible to obtain a neutralisation of the beam 70 at the output of the chamber 10. The compactness of the thruster 10 is as such increased, which is particularly advantageous for the use of this thruster 100 for a small satellite (<500 kg), in particular a micro-satellite (10 kg-100 kg) or a nano-satellite (1 kg-10 kg), for example of the "CubeSat" type.

To this effect, the grid 51 is connected to the radiofrequency voltage source 30 by the intermediary of a means 60 for managing the signal supplied by said radiofrequency voltage source 30 and the electrode 52 is connected to the radiofrequency voltage source 30, in series, by the intermediary of a capacitor 53 and the means 60 for managing the signal supplied by said radiofrequency voltage source 30. The grid 51 is moreover set to a reference potential 55, for example the ground. Likewise, the output of the radiofrequency AC voltage source 30, not connected to the means 60, is also set to the same reference potential 55, the ground according to the example.

In practice, for applications in the space field, the reference potential can be that of the space probe or of the satellite on which the thruster 100 is mounted.

The means 60 for managing the signal supplied by said radiofrequency voltage source 30 thus forms a means 60 which makes it possible to transmit the signal supplied by the radiofrequency AC voltage source 30 in the direction on the one hand, of the or of each coil 40 and on the other hand, of the means 50 for extracting and accelerating ions and electrons out of the chamber 10.

The source 30 (RF—radiofrequencies) is adjusted in order to define a pulse $\omega_{RF}$ such that $\omega_{pi} \leq \omega_{RF} \leq \omega_{pe}$, where:

$$\omega_{pe} = \sqrt{\frac{e_0^2 n_p}{\varepsilon_0 m_e}}$$

is the plasma pulse of electrons and $$\omega_{pi} = \sqrt{\frac{e_0^2 n_p}{\varepsilon_0 m_i}}$$

the plasma pulse of positive ions; with:

$e_0$, the charge of the electron, $\varepsilon_0$, the permittivity of the vacuum, $n_p$, the density of the plasma, $m_i$, the mass of the ions and $m_e$, the mass of the electrons.

Note that $\omega_{pi} << \omega_{pe}$ due to the fact that $m_i >> m_e$.

Generally, the frequency of the signal provided by the source 30 can be between a few MHz and a few hundred MHz, according to the propellant used for the formation of the plasma in the chamber 10 and this, in order to be between the plasma frequencies of the ions and the plasma frequency of the electrons. A frequency of 13.56 MHz is generally well suited, but the following frequencies can also be considered: 1 MHz, 2 MHz or encore 4 MHz.

The electroneutrality of the beam 70 is provided by the capacitive nature of the system 50 for extracting and accelerating car, due to the presence of the capacitor 53, there are on the average as many positive ions as electrons which are extracted over time.

In this framework, the form of the signal produced by the radiofrequency AC voltage source 30 can be arbitrary. It can however be provided that the signal supplied by the radiofrequency AC voltage source 30 to the electrode 52 be rectangular or sinusoidal.

The operating principle for the extraction and the acceleration of the charged particles of the plasma (ions and electrons) with the first embodiment is the following.

By construction, the electrode 52 has a greater surface, and generally clearly greater, than that of the grid 51 located at the output of the chamber 10.

Generally, the application of a voltage RF on an electrode 52 that has a surface that is greater than the grid 51 has for effect to generate on the interface between the electrode 52 and the plasma on the one hand, and on the interface between the grid 51 and the plasma on the other hand, an additional difference in potential, adding to the difference in potential RF. This total difference in potential is distributed over a sheath. The sheath is a space which is formed between the grid 51 or the electrode 52 on the one hand and the plasma on the other hand where the density of positive ions is higher than the density of electrons. This sheath has a variable thickness due to the signal RF, variable, applied to the electrode 52.

In practice, most of the effect of the application of a signal RF on the electrode 52 is however located in the sheath of the grid 51 (the electrode-grid system can be seen as a capacitor with two asymmetrical walls, in this case the difference in potential is applied on the portion with the lowest capacitance therefore with the lowest surface).

In presence of the capacitor 53 in series with the source RF, 30 the application of the signal RF has for effect to convert the voltage RF into constant DC voltage due to the charge of the capacitor 53, primarily on the sheath of the grid 51.

This constant DC voltage in the sheath of the grid 51 implies that the positive ions are constantly extracted and accelerated (continuously). Indeed, this difference in DC potential has for effect to render the plasma potential positive. Consequently, the positive ions of the plasma are constantly accelerated in the direction of the grid 51 (at a reference potential) and therefore extracted from the chamber 10 by this grid 51. The energy of the positive ions corresponds to this difference in DC potential (average energy).

The variation of the voltage RF makes it possible to vary the difference in potential RF+DC between the plasma and the grid 51. On the sheath of the grid 51, this results in a change in the thickness of this sheath. When this thickness becomes less than a critical value, which occurs for a lapse of time at given regular intervals by the frequency of the signal RF, the difference in potential between the grid 51 and the plasma approaches the value zero (therefore the plasma potential approaches the reference potential), which makes it possible to extract electrons.

In practice, the plasma potential below which the electrons can be accelerated and extracted (=critical potential) is given by Child's law, which links this critical potential to the critical thickness of the sheath below which this sheath would disappear ("sheath collapse").

As long as the plasma potential is less than the critical potential, then there is an acceleration and a simultaneous extraction of the electrons and ions.

A good electroneutrality of the beam 70 of positive ions and of electrons at the output of the chamber 10 plasma can as such be obtained.

Figure 2:
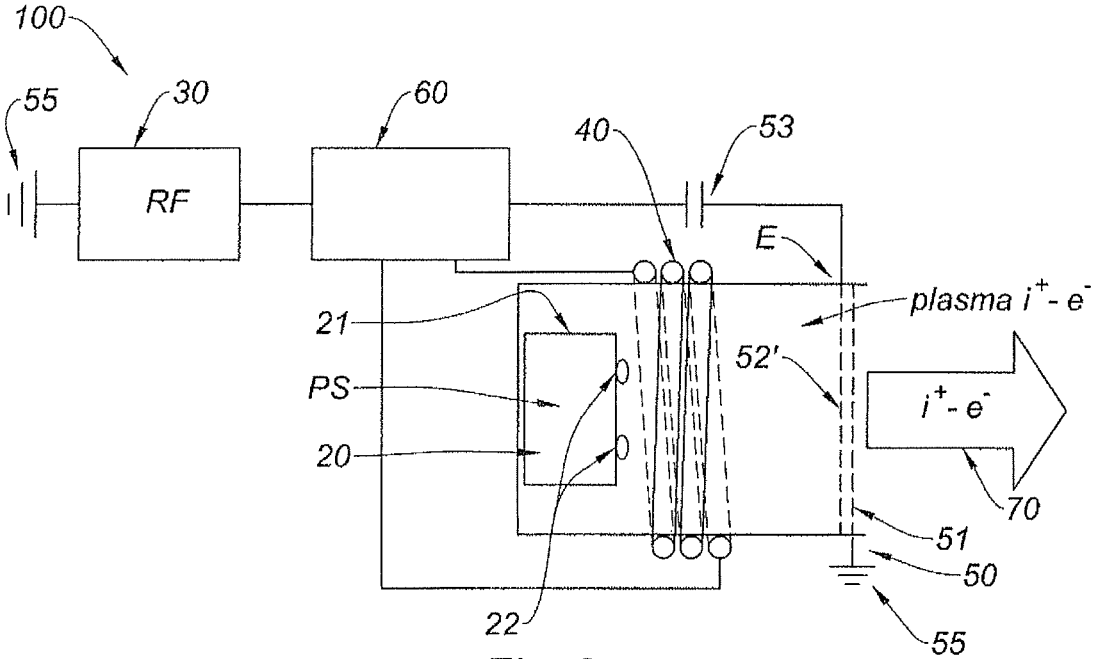
FIG. 2 is a diagrammatical view of an alternative of the first embodiment shown in FIG. 1.

FIG. 2 shows an alternative embodiment to the first embodiment shown in FIG. 1.

The same reference designates the same components.

The difference between the thruster shown in FIG. 2 with respect to the thruster shown in FIG. 1 resides in the fact that the electrode 52 housed inside the chamber 10 is suppressed and that a grid 52' is added on the end E (output) of the chamber 10.

In other terms, the means 50 for extracting and accelerating charged particles of the plasma comprises a set of at least two grids 51, 52' located at one end E (output) of the chamber 10, with one 51 at least of the set of at least two grids 51, 52' being connected to the radiofrequency voltage source 30 by the intermediary of the means 60 for managing the signal supplied by said radiofrequency voltage source 30 and the other 52' at least of the set of at least two grids 51, 52' being connected to the radiofrequency voltage source 30, in series, by the intermediary of a capacitor 53 and of the means 60 for managing the signal supplied by said radiofrequency voltage source 30.

The connection of the grid 52' to the radiofrequency voltage source 30 is, in FIG. 2, identical to the connection of the electrode 52 to this source 30, in FIG. 1.

Each grid 51, 52' can have orifices of different shapes, for example circular, square, rectangle or in the form of slots, in particular parallel slots. In particular, in the case of circular orifices, the diameter of an orifice can be between 0.2 mm and 10 mm, for example between 0.5 mm and 2 mm.

Moreover, the distance between the two grids 52', 51 can be between 0.2 mm and 10 mm, for example between 0.5 mm and 2 mm (the exact choice depends on the voltage DC and on the density of the plasma).

In this alternative, the operation of the extraction and of the acceleration of the positive ions and of the electrons is as follows.

When a voltage RF is applied by the intermediary of the source 30, the capacitor 53 charges. The charge of the capacitor 53 then produces a direct voltage DC at the terminals of the capacitor 53. It is then obtained, at the terminals of the unit formed by the source 30 and the capacitor 53, a voltage RF+DC. The constant portion of the voltage RF+DC, then makes it possible to define an electric field between the two grids 52', 51, with the average value of the only signal RF being zero. This value DC therefore makes it possible to extract and to accelerate the positive ions through the two grids 51, 52', continuously.

Moreover, when this voltage RF is applied, the plasma follows the potential impressed on the grid 52', which is in contact with the plasma, namely RF+DC. As for the other grid 51 (reference potential 55, for example the ground), it is also in contact with the plasma, but only during the brief intervals of time during which the electrons are extracted with the positive ions, namely when the voltage RF+DC is less than a critical value below which the sheath disappears. This critical value is defined by Child's law.

The electroneutrality of the beam 70 at the output of the chamber 10 is as such assured.

Note moreover that, for this embodiment in FIG. 2, the electroneutrality of the beam 70 of ions and of electrons can be obtained at least partially by adjusting the application duration of the positive and/or negative potentials coming from the radiofrequency AC voltage source 30. This electroneutrality of the beam 70 of ions and of electrons can also be obtained at least partially by adjusting the amplitude of the positive and/or negative potentials coming from the radiofrequency AC voltage source 30.

The interest with this alternative is, in relation to the embodiment shown in FIG. 1 and implementing a grid 51 at the end E of the chamber 10 and an electrode 52 housed in the chamber with a surface that is greater than the grid 51 to provide better control of the trajectory of the positive ions. This is linked to the fact that a difference in potential DC (direct) is generated between the two grids 52', 51, under the action of the radiofrequency AC voltage source 30 and of the capacitor 53 in series and not on the sheath between the plasma and the grid 51 (cf. hereinabove) in the case of the first embodiment of FIG. 1.

Therefore, with the alternative embodiment shown in FIG. 2, it is assured that many more positive ions pass through the orifices of the grid 52', without touching the wall of this grid 52', in reference to what happens in the case of the first embodiment shown in FIG. 1.

In addition, the positive ions passing through the orifices of the grid 52' also do not touch the wall of the grid 51 which is visible, from the standpoint of these ions, only through the orifices of the grid 52'. Consequently, the lifespan of the grids 52', 51 according to this alternative embodiment is improved in relation to that of the grid 51 of the first embodiment of FIG. 1.

The lifespan of the resulting thruster 100 is therefore improved.

Finally, the efficiency is improved because the positive ions can be focussed by the set of at least two grids 51, 52', with the flow of neutral species being reduced due to the fact that the transparency to these neutral species increases.

Figure 3:
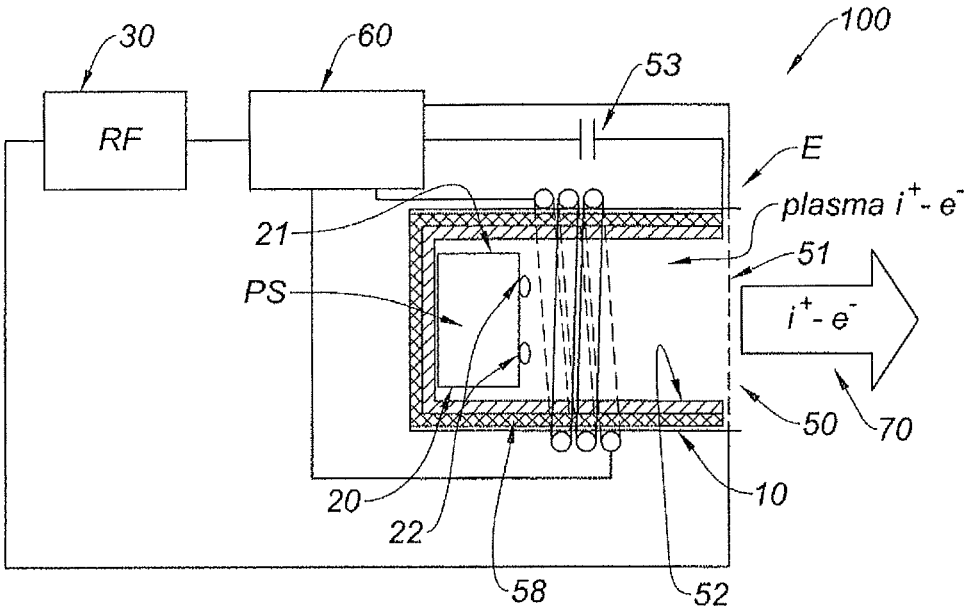
FIG. 3 is a diagrammatical view of another alternative of the first embodiment shown in FIG. 1.

FIG. 3 shows another alternative of the first embodiment of FIG. 1, for which the grid 51 is connected, by its two ends to the radiofrequency AC voltage source 30.

All of the rest is identical and operates in the same way.

Figure 4:
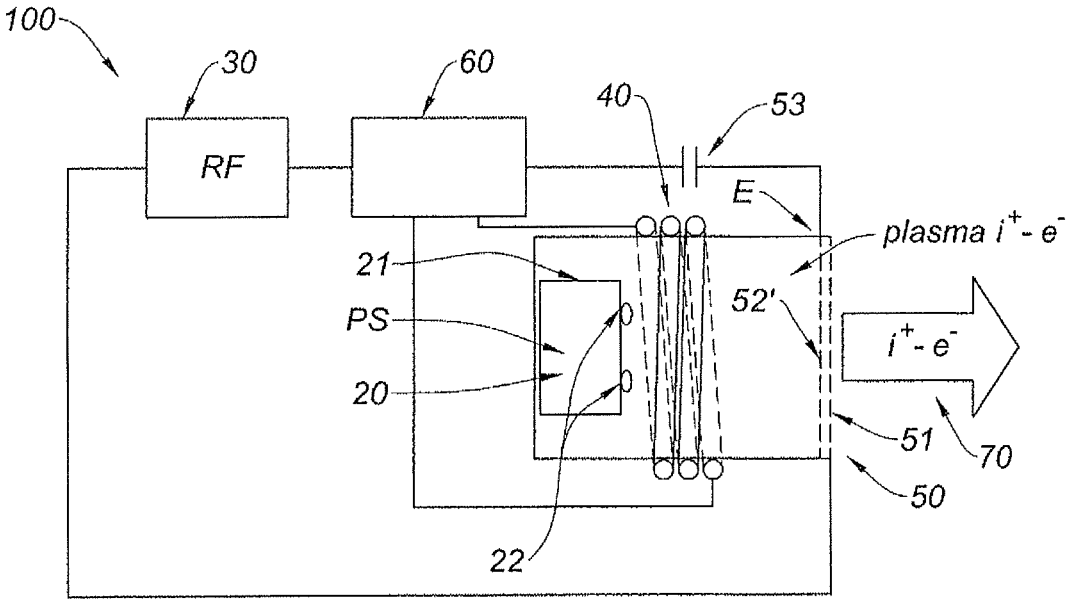
FIG. 4 is a diagrammatical view of another alternative of the first embodiment shown in FIG. 1.

FIG. 4 shows an alternative embodiment to the alternative shown in FIG. 2, for which the grid 51 is connected, by its two ends, to the radiofrequency AC voltage source.

All of the rest is identical and operates in the same way.

The alternatives shown in FIGS. 3 and 4 therefore do not entail the implementing of a reference potential for the grid 51. In the space field, such a connection ensures an absence of parasitic currents circulating between on the one hand, the external conductive portions of the space probe or of the satellite whereon the thruster 100 is mounted and on the other hand, the means 50 for extracting and accelerating charged particles strictly speaking.

Figure 5:
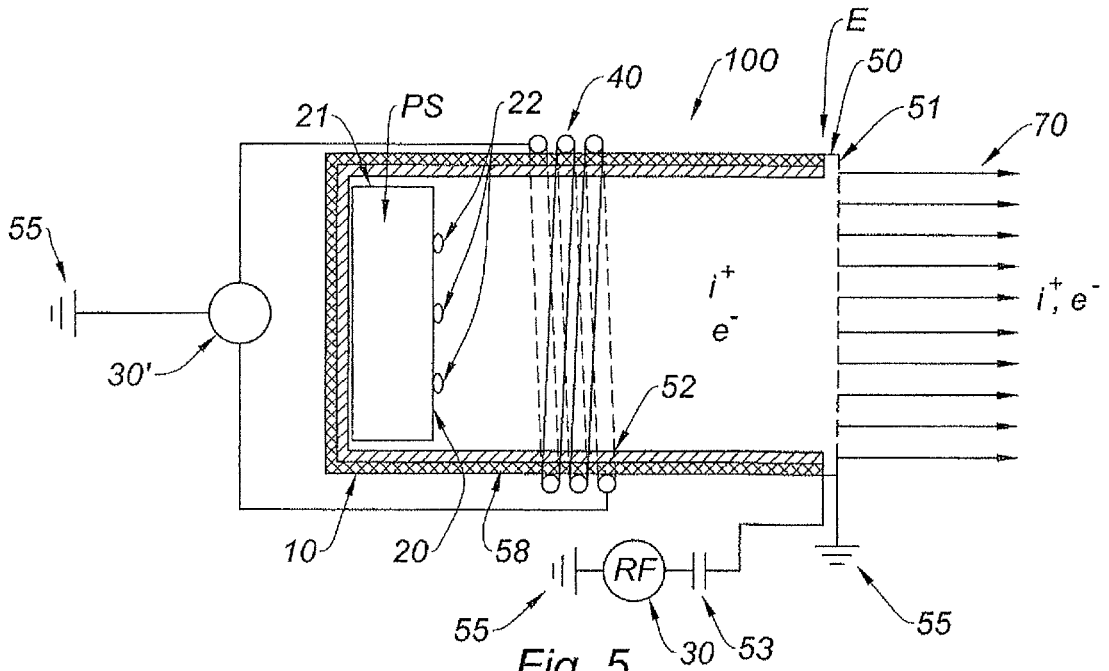
FIG. 5 is a diagrammatical view of a plasma thruster according to a second embodiment of the invention.

FIG. 5 shows a second embodiment of an ion thruster according to the invention.

This is an alternative to the first embodiment shown in FIG. 1 and for which a first radiofrequency AC voltage source 30 is provided to manage the extracting and the accelerating of the charged particles of the plasma out of the chamber 10 and a second AC voltage source 30', separate from the first radiofrequency AC voltage source 30.

The rest is identical and operates in the same way.

In this case, the means 60 for managing the signal supplied by a single radiofrequency AC voltage source 30 such as proposed in FIGS. 1 to 4 is no longer of any interest.

This alternative makes it possible to have more flexibility.

Indeed, if the source 30 used for the extraction and the acceleration of the charged particles out of the plasma remains a radiofrequency AC voltage source of which the frequency is between the plasma frequencies of the ions and the plasma frequency of the electrons, the source 30' can generate a different signal.

For example, the source 30' can generate a radiofrequency AC voltage signal, associated with one or several coils 40 for heating the jacket 21 of the conductive reservoir 20 (made from a metal material for example), evaporate the solid propellant then generate a plasma in the chamber 10, of which the frequency is different from that of the operating frequency of the source 30. The operating frequency of the source 30' can in particular be higher than the operating frequency of the source 30.

According to another example, the source 30' can generate an AC voltage signal in frequencies that correspond to microwaves, associated with one or several microwave antennas 40.

Figure 6:
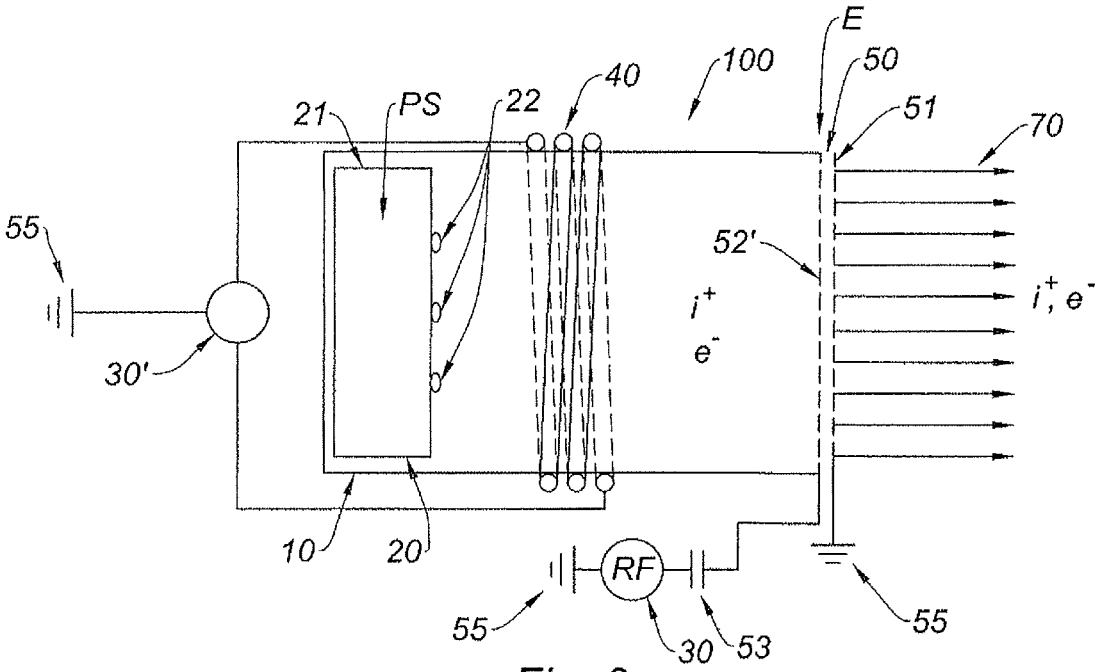
FIG. 6 is a diagrammatical view of an alternative to the second embodiment shown in FIG. 5.

FIG. 6 shows an alternative to the second embodiment shown in FIG. 5.

The difference between the thruster 100 shown in FIG. 5 and that which is shown in FIG. 1 resides in the fact that the electrode 52 housed inside the chamber 10 is suppressed and that a grid 52' is added on the end E (output) of the chamber 10.

The rest is identical and operates in the same way.

In other terms, the difference between the alternative shown in FIG. 6 and the second embodiment of FIG. 5 is the same as that which was shown hereinabove between the alternative shown in FIG. 2 and the first embodiment of FIG. 1.

Figure 7:
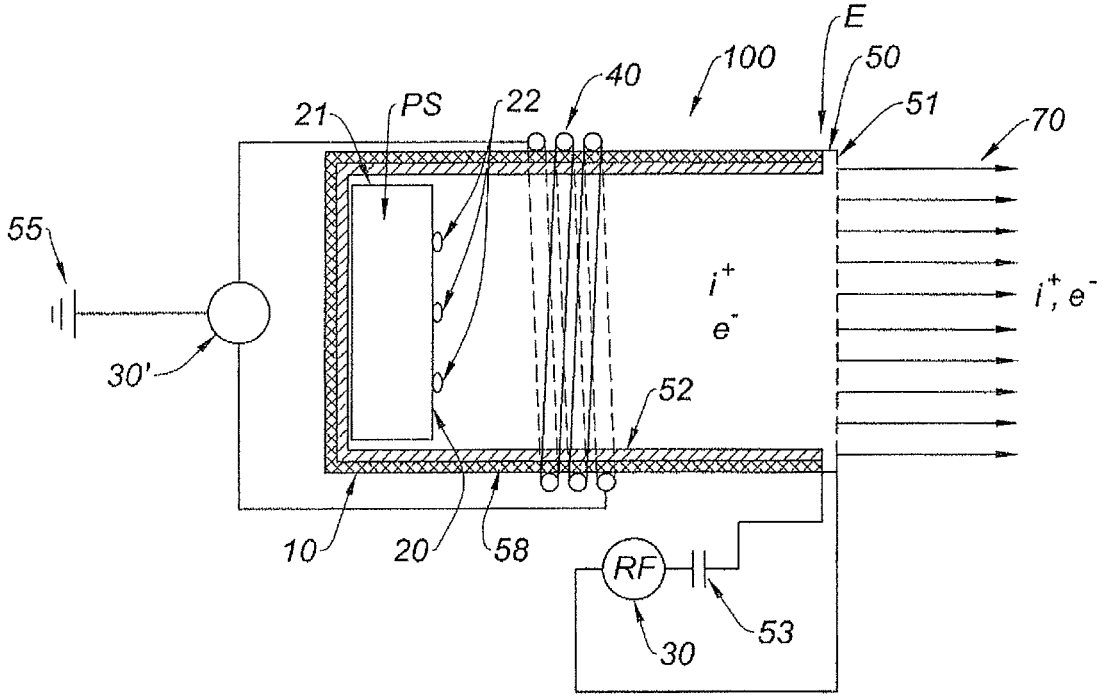
FIG. 7 is a diagrammatical view of another alternative to the second embodiment shown in FIG. 5.

FIG. 7 shows another alternative of the second embodiment of FIG. 5, for which the grid 51 is connected to the radiofrequency AC voltage source 30.

All of the rest is identical and operates in the same way.

Figure 8:
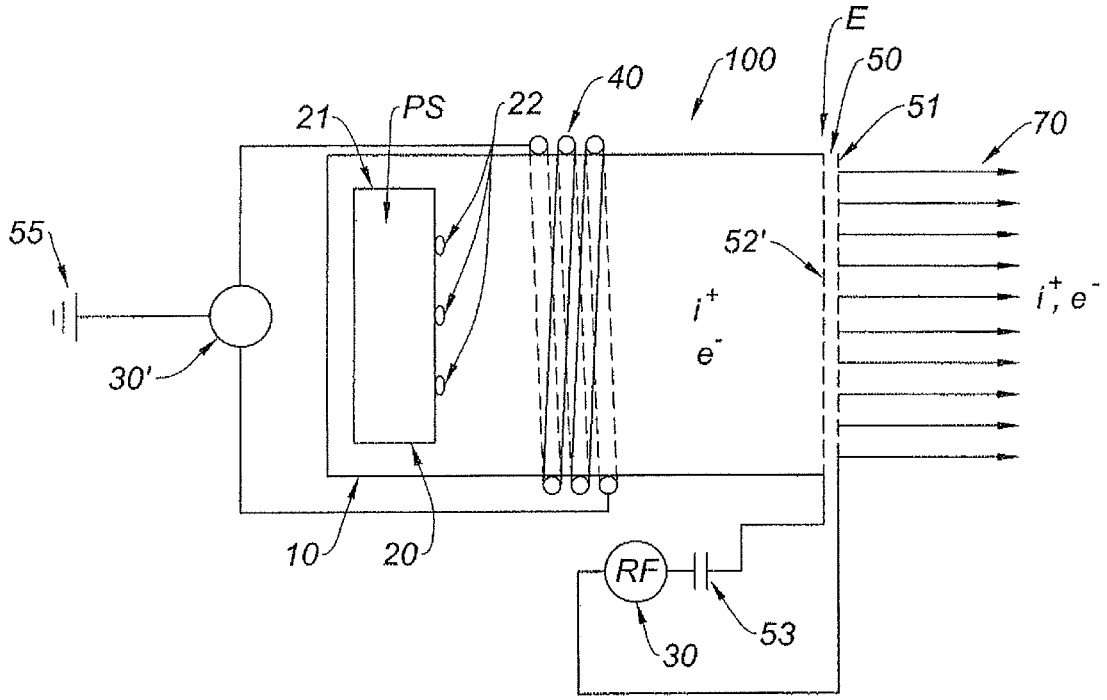
FIG. 8 is a diagrammatical view of another alternative to the second embodiment shown in FIG. 5.

FIG. 8 shows an alternative embodiment to the alternative shown in FIG. 6, for which the grid 51 is connected to the radiofrequency AC voltage source 30.

All of the rest is identical and operates in the same way.

The alternatives shown in FIGS. 7 and 8 therefore do not entail the implementing of a reference potential 55 for the grid 51. As explained hereinabove, in the space field, such a connection ensures an absence of parasitic currents circulating between on the one hand, the external conductive portions of the space probe or of the satellite whereon the thruster 100 is mounted and on the other hand, the means 50 for extracting and accelerating charged particles strictly speaking.

Figure 9:
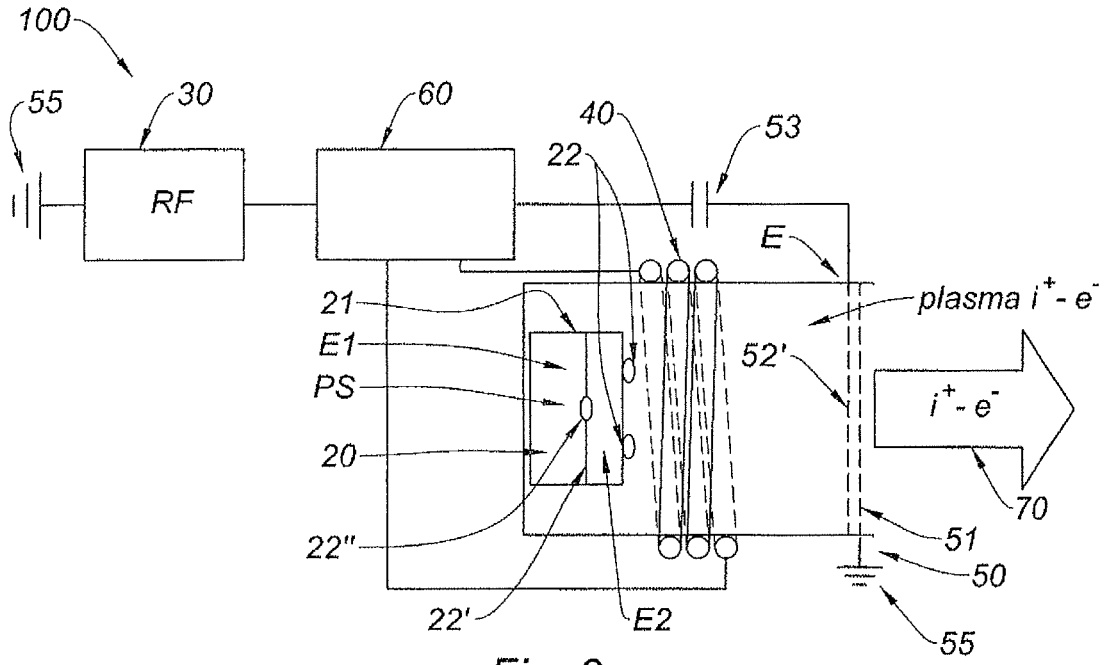
FIG. 9 is a diagrammatical view of an alternative embodiment of the thruster plasma shown in FIG. 8

FIG. 9 shows an alternative embodiment to the thruster 100 shown in FIG. 8.

This alternative embodiment differs from that which is shown in FIG. 8 by the fact that the reservoir 20 comprises two stages E1, E2 for injecting propellant in the gaseous state to the plasma chamber 10.

Indeed, in FIG. 8, and elsewhere in all of the FIGS. 1 to 7, the reservoir 20 comprises a jacket 21 of which a wall is provided with one or several orifices 22, therefore defining a reservoir with a single stage.

Au contraire, in the alternative shown in FIG. 9, the reservoir comprises, furthermore, a membrane 22' comprising at least one orifice 22" and which separates the reservoir into two stages E1, E2. More precisely, the reservoir 20 comprises a membrane 22' located between the solid propellant PS and the jacket 21 provided with at least one orifice 22, said membrane 22' comprising at least one orifice 22", the surface of the or each orifice 22" of the membrane 22' being larger than the surface of the or of each orifice 22 of the jacket 21 of the reservoir 20.

This alternative has an interest when, in light of the sizing of the or of each orifice 22 on the jacket 21 of the reservoir 20 in order to obtain in particular the desired operating pressure P2 in the plasma chamber 10, this results in defining orifices that are too small. These orifices may then not be able to be produced technically. These orifices can also, although producible technically, be too small to ensure that the dusts of solid propellant and more generally, of impurities, do not block the orifices 22 during use.

In this case, the or each orifice 22" of the membrane 22' is sized in such a way that it is larger than the or each orifice 22 made on the jacket 21 of the reservoir 20, with the or each orifice 22 remaining sized to obtain the desired operating pressure P2 in the plasma chamber 10.

Of course, a reservoir 20 with a double stage can be considered for all of the embodiments described in terms of FIGS. 1 to 7.

Figure 10:
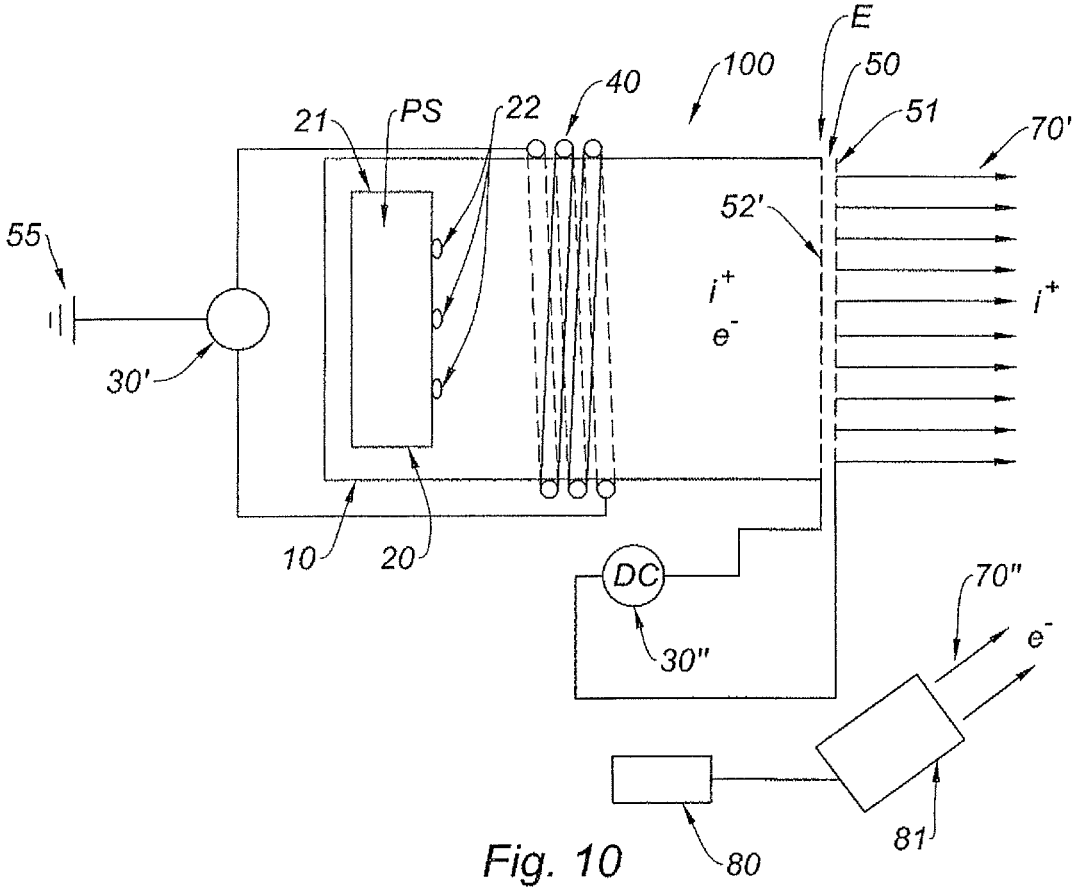
FIG. 10 is a diagrammatical view of a third embodiment of the invention.

FIG. 10 shows a third embodiment of an ion thruster according to the invention.

This figure is an alternative to the embodiment of FIG. 8 (grids 52' and 51' both connected to the voltage source). However, it also applies as an alternative in FIG. 6 (grid 52' connected to the source and grid 51 connected to the ground), in FIG. 7 (electrode 52 and grid 51 both connected to the voltage source), in FIG. 5 (electrode 52 connected to the source and grid 51 connected to the ground) and in FIG. 9.

The thruster 100 shown here makes it possible to form a beam 70' of positive ions at the output of the chamber 10 plasma. For this, the radiofrequency AC voltage source 30 is replaced with a direct voltage source (DC) 30". In order to ensure the electroneutrality of the beam 70', electrons are injected into the beam 70' by a device external 80, 81 to the chamber 10. This device comprises a power source 80 powering a generator of electrons 81. The electron beam 70" exiting the electron generator 81 is directed to the beam 70' of positive ions in order to ensure electroneutrality.

Figure 12:
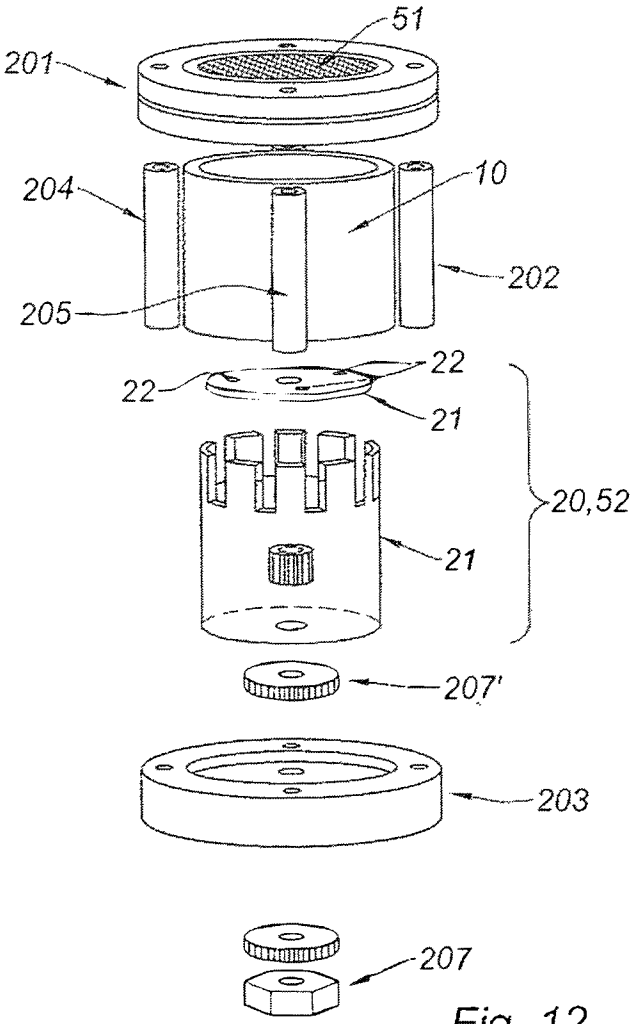
FIG. 12 is an exploded view of the reservoir shown in FIG. 9.
Figure 11:
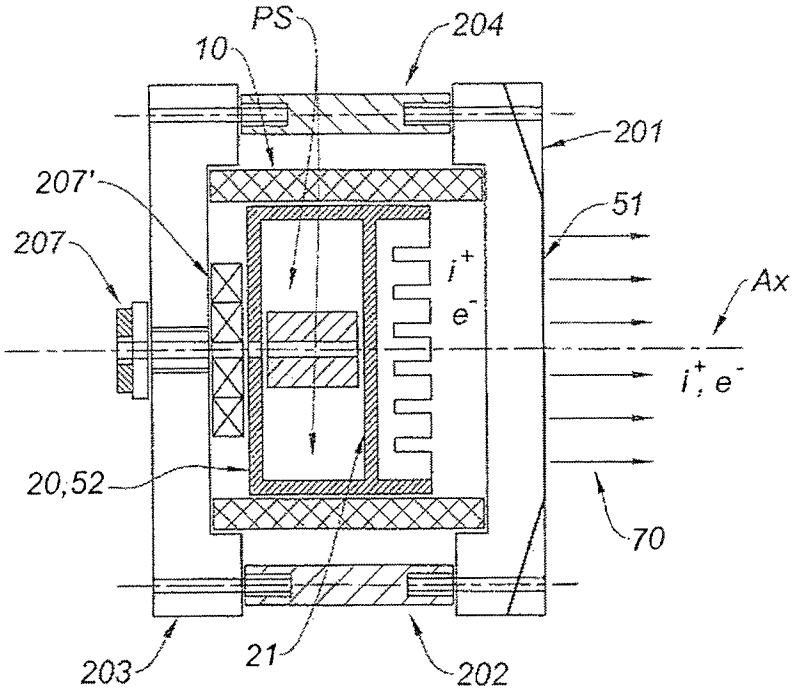
FIG. 11 is a cross-section view of a solid propellant reservoir able to be used in a plasma thruster according to the invention, regardless of the embodiment considered, with its environment allowing it to be mounted inside the plasma chamber.

FIGS. 11 and 12 show a design that can be considered for a plasma chamber 10 and its environment for a thruster 100 in accordance with the embodiments of FIG. 1, of FIG. 3, of FIG. 5 or of FIG. 7.

In these figures, the plasma chamber 10, the reservoir 20 with its jacket 21 and the orifices 22 are recognised. The reservoir 20 is also used as an electrode 52. In the case here, three orifices 22 have been shown, equally distributed about the axis of symmetry AX of the reservoir 20. The jacket 21 is made from a conductive material, for example metal (Aluminium, Zinc or a metal material covered by gold, for example) or from a metal alloy (stainless steel or brass, for example). Therefore, eddy currents and subsequently, a Joule effect can be produced in the jacket 21 of the reservoir 20 under the action of the AC voltage source 30, 30' and of the coil 40 or, according to the case, of the microwave antenna 40. The transmission of the heat between the jacket 21 of the reservoir 20 and the solid propellant PS can be carried out via thermal conduction and/or thermal radiation.

The chamber 10 is sandwiched between two rings 201, 202, mounted together by the intermediary of rods 202, 204, 205 extending along the chamber 10 (longitudinal axis AX). The chamber 10 is made from a dielectric material, for example ceramics. The fastening of the rings and of the rods can be carried out with bolts/nuts (not shown). The rings can be made from a metal material, for example from aluminium. As for the rods, they are for example made from ceramics or from a metal material.

The unit formed as such by the rings 201, 203 and the rods 202, 204, 205 allows for the fastening of the chamber 10 and of its environment, by the intermediary of additional portions 207, 207', which sandwich one 203 of the rings, on a system (not shown in FIGS. 11 and 12) intended to receive the thruster, for example a satellite or a space probe.

Example of Sizing.

An ion thruster 100 in accordance with the one shown in FIG. 1 was tested.

The plasma chamber 10 and its environment are in accordance with what was described using FIGS. 11 and 12. The materials were chosen for a maximum acceptable temperature of 300° C.

The solid propellant PS used is diatomic iodine ($I_2$, dry weight of about 50 g).

Several orifices 22 were provided on the conductive jacket 21 of the reservoir 20 in order to pass the diatomic iodine gas from the reservoir 20 to the plasma chamber 10 (reservoir 20 with a single stage).

A reference temperature T1 for the reservoir 20 was set to 60° C. This can be obtained with a power of 10 W on the radiofrequency AC voltage source 30. The frequency of the signal supplied by the source 30 is chosen to be between the plasma frequencies of the ions and the plasma frequency of the electrons, here 13.56 MHz.

The pressure P1 of the diatomic iodine gas in the reservoir 20 is then known by FIG. 13 (case with $I_2$; cf. the corresponding formula F1), with the latter providing the link between P1 and T1. In the case here, P1 is 10 Torr (about 1330 Pa).

In order to obtain optimal efficiency, the pressure P2 in the chamber 10 must then be between 7 Pa and 15 Pa with a mass flow rate m' of diatomic iodine gas less than 15 sccm ($\cong 1.8\cdot 10^{-6}$ kg·s$^{-1}$) between the reservoir 20 and the chamber 10.

It can then be estimated that the equivalent diameter of the orifice (circular) is about 50 microns. When the orifice is unique, it will then have a diameter of 50 microns. When several orifices are provided, which is the case in the test carried out, it is then suitable to determine the surface of this orifice and to distribute this surface over several orifices in order to obtain the diameter of each one of the orifices, which will advantageously be the same.

However, in order to provide a few additional sizing elements corresponding to the numerical values supplied hereinabove, the following points can be noted, in the case of an orifice 22 of surface A.

The volumetric flow rate through the orifice 22 can be estimated by the relationship:

$$Q = v/4A(P_1 - P_2) \quad \text{(R1)}$$

where:

$P_1$ is the pressure in the reservoir 20;

$P_2$ is the pressure in the chamber 10; and v is the average speed of the molecules of diatomic iodine gas, determined by the relationship:

$$v = \sqrt{\frac{8kT_1}{\pi m}} \quad \text{(R2)}$$

where:

$T_1$ is the temperature in the reservoir 20;

k is the Boltzmann constant ($k \approx 1.38\cdot 10^{-23}$ J·K$^{-1}$); and m is the weight of one molecule of the diatomic iodine gas ($m(I_2) \approx 4.25\cdot 10^{-25}$ kg).

The mass flow rate m' of diatomic iodine gas through the orifice 22 is then obtained by the relationship:

$$m'[\text{kg/s}] = \frac{MQ}{RT_1} \quad \text{(R3)}$$

where:

M is the molar weight of the iodine (for $I_2$, M≈254 u); and

R is the molar constant of the gases (R≈8.31 J/mol·K).

By combining relationships (R1) and (R3), the surface A of the orifice 22 is deduced therefrom by the relationship:

$$A = \frac{4m' RT_1}{vM(P_1 - P_2)} \quad \text{(R4)}$$

The orifice 22 is then dimensioned.

As can be observed in the relationship (R4), the temperature T2 in the plasma chamber 10 does not intervene. A more precise modelling could be obtained by taking account of this temperature T2. For more general data on this sizing, reference can be made to: *A User Guide To Vacuum Technology*, third ed., Johan F. O'Hanlon (John Wiley & Sons Inc., 2003).

Once the surface A of the orifice 22 is dimensioned, the mass flow rate $m'_{leak}$ (kg/s) for leakage of diatomic iodine gas when the thruster 100 is stopped can be determined by the relationship:

$$m'_{leak}[\text{kg/s}] \propto \frac{AP_0Mv_0}{4RT_0} \quad \text{(R5)}$$

where:

$T_0$ is the temperature of the thruster 100 when stopped;

$P_0$ is the pressure of the gas in the reservoir 20 when the thruster is stopped, with this pressure being supplied by the formula F1 (cf. FIG. 13) at the temperature $T_0$; and $v_0$ is obtained by using the relationship (R2) by substituting $T_1$ with $T_0$.

End of the example.

Note that the positioning of the or of each orifice, shown in the annexed figures on one face of the jacket of the reservoir 20 facing the plasma chamber 10 could be different. In particular, it is entirely possible to consider arranging the or each orifice on the opposite face of the reservoir 20.

Finally, the thruster 100 according to the invention can in particular be used for a satellite S or a space probe SP.

Figure 14:
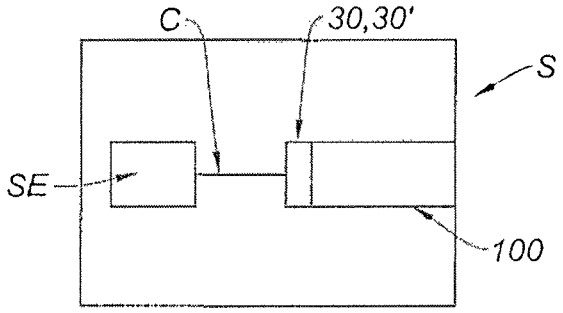
FIG. 14 shows, diagrammatically, a satellite comprising a plasma thruster according to the invention.

As such, FIG. 14 shows, diagrammatically, a satellite S comprising a thruster 100 according to the invention and a source of energy SE, for example a battery or a solar panel, connected to the or to each DC 30" or AC 30, 30' voltage source (radiofrequency or microwave, according to the case) of the thruster 100.

Figure 15:
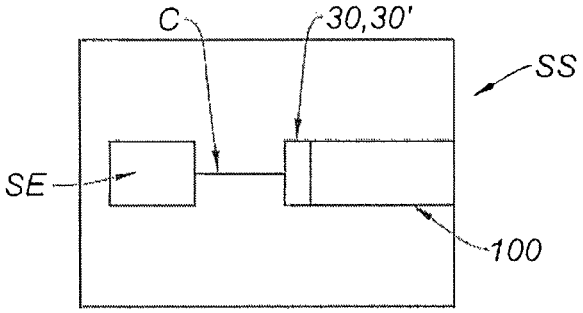
FIG. 15 shows, diagrammatically, a space probe comprising a plasma thruster according to the invention.

FIG. 15 diagrammatically shows a space probe SS comprising a thruster 100 according to the invention and a source of energy SE, for example a battery or a solar panel, connected to the or to each DC 30" or AC 30, 30' voltage source (radiofrequency or microwave, according to the case) of the thruster 100.

The invention claimed is:

1. An ion thruster comprising:

a chamber;

a reservoir comprising a solid propellant, said reservoir being housed in the chamber and comprising a conductive jacket provided with at least one orifice;

at least one coil or at least one microwave antenna, wherein said at least one coil or said at least one microwave antenna sublimes the solid propellant in the reservoir to form a propellant in a gaseous state, which enters the chamber from the reservoir through said at least one orifice, wherein said at least one coil or said at least one microwave antenna generates plasma in the chamber from the propellant in the gaseous state in the chamber, wherein said plasma comprises ions and electrons;

a source of voltage comprising either a radiofrequency AC voltage source arranged in series with a capacitor and adapted for generating a signal having a radiofrequency between plasma frequencies of the ions and a plasma frequency of the electrons, or a DC voltage source;

means for extracting and accelerating the ions comprising a first grid located at an outlet end of the chamber and either a second grid located at the outlet end of the chamber or an electrode, wherein said first grid is connected to a first voltage output of the voltage source, and wherein (i) the second grid is connected to a reference potential, (ii) the second grid is connected to a second output of the source of voltage, or (iii) the electrode is connected to the reference potential, or the electrode is connected to the second output of the source of voltage;

wherein the means for extracting and accelerating the ions extracts and accelerates at least the ions so as to form a beam comprising at least the ions at the outlet end.

2. The ion thruster of to claim 1, wherein the source of voltage is the radiofrequency AC voltage source arranged in series with a capacitor, wherein the at least one coil is powered by the radiofrequency AC voltage source and wherein the means for extracting and accelerating the ions is powered by the radiofrequency AC voltage source arranged in series with a capacitor.

3. The ion thruster of claim 1, wherein either another radiofrequency AC voltage source powers the at least one coil, or a microwave AC voltage source powers the at least one microwave antenna.

4. The ion thruster of claim 3, wherein the source of voltage is the radiofrequency AC voltage source, and wherein said beam further comprises electrons.

5. The ion thruster of claim 2, wherein, when the means for extracting and accelerating the ions comprises the first grid and the second grid, and wherein an electroneutrality of said beam is obtained at least partially by adjusting a duration of positive and/or negative potentials coming from the radiofrequency AC voltage source.

6. The ion thruster of claim 2, wherein, when the means for extracting and accelerating the ions comprises the first grid and the second grid, and wherein an electroneutrality of said beam is obtained at least partially by adjusting an amplitude of positive and/or negative potentials coming from the radiofrequency AC voltage source.

7. The ion thruster of according to claim 3, further comprising an electron generator for injecting additional electrons into said beam in order to provide electroneutrality.

8. The ion thruster of claim 1, wherein the reservoir comprises a membrane located between the solid propellant and the jacket, said membrane comprising at least one aperture, wherein a surface area of the at least one aperture is larger than a surface of the at least one orifice.

9. The ion thruster of claim 1, further comprising apertures which are circular, square, rectangle or in the form of slots, wherein the first grid comprises the apertures or wherein the first grid and the second grid comprise the apertures.

10. The ion thruster of claim 1, wherein the apertures are circular orifices having a diameter between 0.2 mm and 10 mm.

11. The ion thruster of claim 1, wherein, when the means for extracting the ions comprises the first grid and the second grid and wherein a distance between the first grid and the second grid is between 0.2 mm and 10 mm.

12. The ion thruster of claim 1, wherein the solid propellant is chosen from: diatomic iodine, diatomic iodine mixed with other chemical components, ferrocene, adamantane, or arsenic.

13. A satellite comprising an ion thruster claim 1 and a source of energy connected to the source of voltage.

14. A space probe comprising an ion thruster claim 1 and a source of energy connected to the source of voltage.

* * * * *